US008240824B2

(12) United States Patent
Kieser et al.

(10) Patent No.: US 8,240,824 B2
(45) Date of Patent: Aug. 14, 2012

(54) PLUG CONNECTION FOR AN INK SUPPLY

(75) Inventors: Axel Kieser, Berlin (DE); Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 362 days.

(21) Appl. No.: 12/760,622

(22) Filed: Apr. 15, 2010

(65) Prior Publication Data

US 2011/0254902 A1 Oct. 20, 2011

(30) Foreign Application Priority Data

Jun. 15, 2009 (DE) ..... 20 2009 008 212 U

(51) Int. Cl.
*B41J 2/175* (2006.01)

(52) U.S. Cl. ..... 347/85; 347/86

(58) Field of Classification Search ..... 347/84, 347/85, 86, 87
See application file for complete search history.

(56) References Cited

U.S. PATENT DOCUMENTS 5,646,664 A * 7/1997 Pawlowski, Jr. ..... 347/86
6,099,112 A 8/2000 Olazabal
6,130,695 A * 10/2000 Childers et al. ..... 347/85
6,188,417 B1 2/2001 Keefe et al.
2004/0027432 A1 2/2004 Childers et al.
2005/0011916 A1 1/2005 Battista et al.

* cited by examiner

*Primary Examiner* — Anh T. N. Vo
(74) *Attorney, Agent, or Firm* — Schiff Hardin LLP

(57) ABSTRACT

A plug connection for an ink supply, which has an ink supply connector, allows removable connection of the ink supply to an ink-consuming component that carries a rapid action cartridge coupling that forms a fluid connection with the ink supply connector. An ink connection holder is attachable to the ink supply connector and has an opening therein receives the rapid action cartridge coupling. An unlocking element releasable holds the ink connection holder to the ink supply connector when the rapid action cartridge coupling is inserted therein. The ink connection holder has a guide for the rapid action cartridge coupling, and each of the guide and the rapid action cartridge coupling are coded, with complementary mechanical codings, so that the ink connection holder can receive only an appropriately coded rapid action cartridge coupling.

23 Claims, 7 Drawing Sheets

Section A-A'

PLUG CONNECTION FOR AN INK SUPPLY

BACKGROUND OF THE INVENTION

1. Field of the Invention

The present invention concerns a plug connection for an ink supply.

2. Description of the Prior Art

As used herein, a plug connection means an ink connection holder for ink print heads or for special ink cartridges of an ink printing system that is suitable to establish a detachable connection between an ink print head or a special ink cartridge and a rapid action cartridge coupling and a fluid connection with a tube system. For example, such an ink connection holder serves as a cartridge connector and can be used in maximally loaded ink printing systems which, among other things, are used in franking machines and in mail processing apparatuses that print a very high number of mail pieces.

A device for ink supply of a print head is known from the European Patent EP 733 481 B1. An ink reservoir can be connected with the print head. This ink reservoir is equipped with a pressure regulation that prevents the negative pressure in the ink print head from varying.

Furthermore, ink printing systems are known that essentially consist of a special ink cartridge with an ink reservoir, with a connector to the ink supply and with an ink print head; a tube system with pressure regulation; and an ink tank, available from Hewlett Packard Development Co. Further details of the special printing system from HP can be learned at the Internet site http://www.hp.com/oeminkjet.

The connection between the special ink cartridge with the ink reservoir and with the ink print head (FIG. 1) and tube system is produced by a securing cap (FIG. 2) and a rapid action cartridge coupling (FIG. 3) such that initially the securing cap is placed on a connector of the ink cartridge for ink supply to the ink print head, and then the rapid action cartridge coupling is plugged into the securing cap. For the ink connection, a hollow needle is pushed into a septum, and finally the rapid action cartridge coupling is connected with the special ink cartridge or with the ink print head by being pushed further by means of a latching mechanism (snap-in) in the securing cap (FIG. 4).

A significant disadvantage of the aforementioned solution is that there is no detachment capability of the rapid action cartridge coupling from the connector of the special ink cartridge, or the ink print head, when the useful life of the ink print head is reached. If the special ink cartridge need not be exchanged, the securing cap must be destroyed since the cap is not placed on the connector of the special ink cartridge, or the ink print head in such a manner that it can be detached without destruction.

SUMMARY OF THE INVENTION

An object of the invention is to provide a detachable, fluid plug connection between the connector of a special ink cartridge or an ink print head and a rapid action cartridge coupling in order to simplify the exchange of the ink print head or the special ink cartridge with ink print head.

Additional desirable features are:

No geometric modifications may occur at the ink print head or, respectively, at the ink cartridge itself and the ink connection and at the rapid action cartridge coupling.

A secure guidance of the rapid action cartridge coupling should be ensured.

A safeguard against confusion of components of the plug connection of the ink printing system that is modified according to the invention relative to those of ink printing systems known from the prior art is to be established. It is thereby to be avoided that rapid action cartridge couplings of the plug connection according to the invention can be connected with the securing cap of the plug connection known according to the prior art.

For a system that is equipped with different ink colors, only ink print heads/cartridges of a suitable type (correct ink) should be usable in the system (with the matching ink) belonging to these. The use of incorrect print heads or cartridges should be mechanically prevented.

A plug connection for ink supply in accordance with the invention has an ink connection holder with an unlocking (unlatching) element and with a guide that accepts a rapid action cartridge coupling. The guide is configured to accept a rapid action cartridge coupling that has a known structure and configuration, with the exception of the rapid action cartridge coupling being mechanically coded. The guide has a corresponding mechanical coding, so that the guide accepts only a coded rapid action cartridge coupling with a mechanical coding that corresponding to the mechanical coding of the guide.

A first variant of a plug connection for ink supply has an ink connection holder with a mountable unlocking button and with a mountable guide piece to guide a coded rapid action cartridge coupling, a coding ring is mounted on a known rapid action cartridge coupling. The ink connection holder can advantageously be used in a plug connection for ink supply to an ink print head or to a special ink cartridge.

The ink connection holder replaces the previously used securing cap that has no unlocking button. In the ink connection holder the unlocking button is directed perpendicular to the mounting movement of the rapid action cartridge coupling and is secured against falling out.

A second variant of a plug connection for ink supply has an ink connection holder with a detachable second snap-in connector and a guide permanently molded on the base body to guide a coded rapid action cartridge coupling.

The connection between the ink connection mount and the rapid action cartridge coupling is designed such that it can be detached by means of the unlocking button or by means of a detachable second snap-in connector.

A secure and unambiguous guide of the rapid action cartridge coupling within the ink connection holder or, respectively, cartridge connector is ensured by the guide piece or the guide permanently molded on the base body.

Moreover, placing the coding component on the known rapid action cartridge coupling prevents a coded rapid action cartridge coupling, that is provided only for the plug connection for ink supply according to the invention, from being connected with a known securing cap.

In order to mechanically prevent the use of incorrect ink print heads/cartridges, ink connection holder and coding components are executed in different variations, wherein a complementary molded counterpart is attached on the ink connection holder to form a segment of the coding component so that the coding component and the counterpart can only be plugged together in pairs according to the key/lock principle.

DESCRIPTION OF THE PREFERRED EMBODIMENTS

Figure 1:
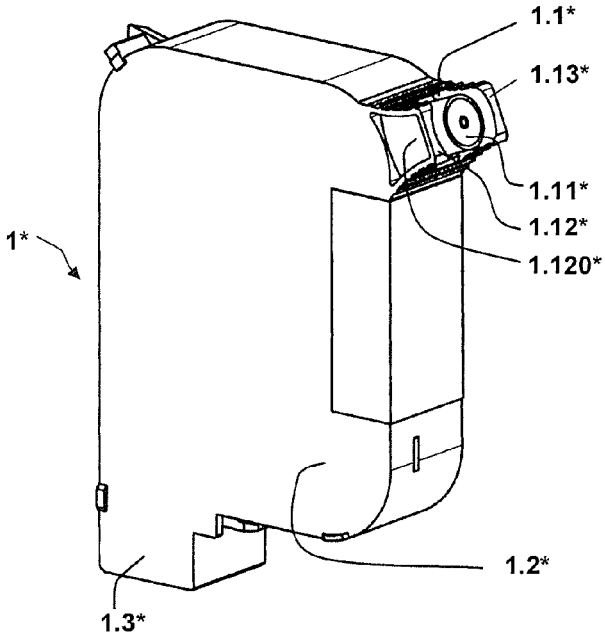
FIG. 1 is a perspective view of a special ink cartridge from HP.

FIG. 1 shows a perspective view of a known special ink cartridge 1* from HP which is equipped with a connector 1.1* for ink supply, with an ink reservoir in the belly 1.2* of the ink cartridge and with an ink print head 1.3*.

The connector 1.1* centrally has a cylindrical septum 1.11* which externally terminates the ink reservoir. A clip 1.12* and 1.13* is respectively molded on the connector 1.1* on both sides of the septum 1.11*. The clips 1.12* and 1.13* respectively have a cavity 1.120* and 1.130* (1.130* not visible) molded in the two flat sides of the ink cartridge 1* as well as an edge. Such special ink cartridges from HP can be used in some ink printing systems for high-use printers, for example also in a franking machine.

Figure 2:
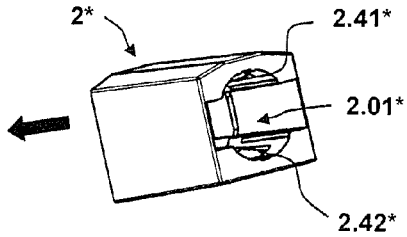
FIG. 2 is a perspective view of a known securing cap.

FIG. 2 shows a perspective view of a known securing cap 2* that is used in connection with a known rapid action cartridge coupling and prevents a detaching of the latter. For this purpose, the securing cap 2* has two elastic catch noses or lugs 2.41* and 2.42*. The securing cap 2* is placed on the connector 1.1* and then the rapid action cartridge coupling 3* is inserted into the opening 2.01* of the securing cap 2* in the direction of the mounting movement (black arrow).

Figure 3:
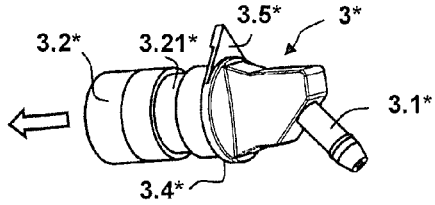
FIG. 3 is a perspective view of a known rapid action cartridge coupling.

FIG. 3 shows a perspective view of the known rapid action cartridge coupling 3* which possesses a hose connector 3.1* for ink supply at one end and a coupling 3.2* at the other end which is inserted into the opening of the securing cap in the direction of the mounting movement (white arrow). The coupling bears on the outside an annular groove 3.21* which, given a mounted rapid action cartridge coupling 3*, engages with the aforementioned catch noses. The rapid action cartridge coupling 3* has an annular edge 3.4* with a nose 3.5* mounted on the circumference.

Figure 4:
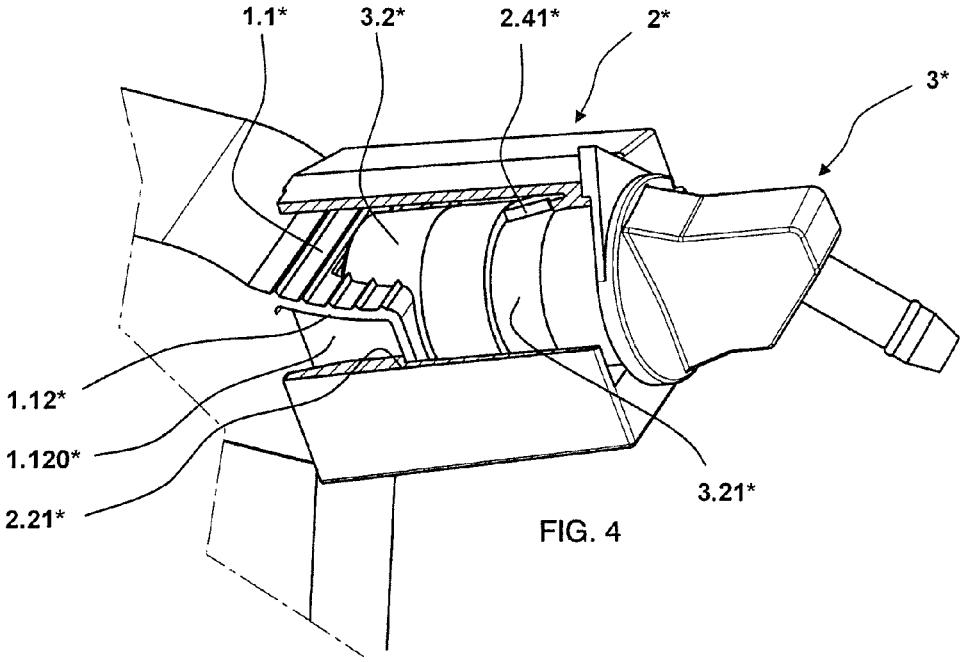
FIG. 4 is a perspective view of a securing cap mounted in a known manner on the connector for ink supply, into which securing cap the rapid action cartridge coupling is inserted.

FIG. 4 shows a perspective view of a securing cap 2* mounted—in a known manner—on the connector 1.1* for ink supply, into which securing cap 2* the rapid action cartridge coupling 3* with its coupling 3.2* is inserted, wherein the securing cap 2* is shown in section. Inside the securing cap 2* is a hollow space that is matched to the external dimensions of the rapid action cartridge coupling 3* and is adapted to the external dimensions of the terminal 1.1*. At the side of the connector 1.1* for ink supply, the opening of the hollow space of the securing cap 2* widens conically until a step-shaped shoulder 2.21*. The side walls of the securing cap 2* are elastic for a widening upon placement, which facilitates the mounting of the securing cap 2* on the connector 1.1*.

The connector 1.1* transitions on both sides into the clips 1.12* and 1.13*) not visible) that each include a molded cavity 1.120* and 1.130* (1.130* not visible) so that a clip edge is formed. The edge of the clips 1.12* and 1.13* on both sides of the septum respectively projects behind an edge 2.21* (2.22* not visible) of the step-shaped shoulder of the securing cap 2*. The edge of the clips 1.12*, 1.13* (1.13* not visible) and the associated edge 2.21* (2.22* not visible) form a first snap-in connection. The connector 1.1* centrally has a cylindrical septum (not visible) on which the coupling 3.2* is placed, whereby the annular groove 3.21* of the rapid action cartridge coupling 3* engages with the elastic catch nose 2.41* which, with the groove 3.21*, forms a second snap-in connection.

Figure 5:
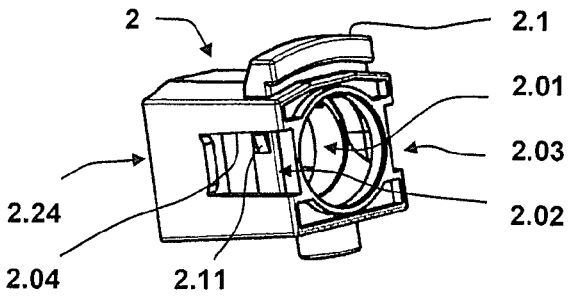
FIG. 5 is a perspective view of the ink connection holder of the plug connection for ink supply according to the invention.

FIG. 5 shows a perspective view of the inventive ink connection holder 2 of the plug connection for ink supply. The ink connection holder 2 has a first opening 2.01 for insertion of the rapid action cartridge coupling and a laterally arranged second opening 2.02 for engaging catch noses, as well as a third opening 2.03 arranged on the opposite side. The ink connection holder 2 has a fourth opening 2.24 of placement of the ink connection holder 2 on the connector (not shown) of an ink print head or a special ink cartridge.

The ink connection holder 2 has an unlocking button 2.1 that has two catch noses on both sides on the narrow lateral surfaces. The catch noses engage in the ink connection holder itself if the unlocking button 2.1 is mounted. The catch noses on both sides are pressed against stop edges on the narrow lateral surfaces of the unlocking button 2.1 charged with an elastic force. The catch nose 2.11 on the left lateral surface abuts against a stop edge 2.04 on the left side of the ink connection holder 2. Although the right side of the ink connection holder 2 and the right lateral surface of the unlocking button 2.1 are not visible, they are designed analogously.

Figure 6:
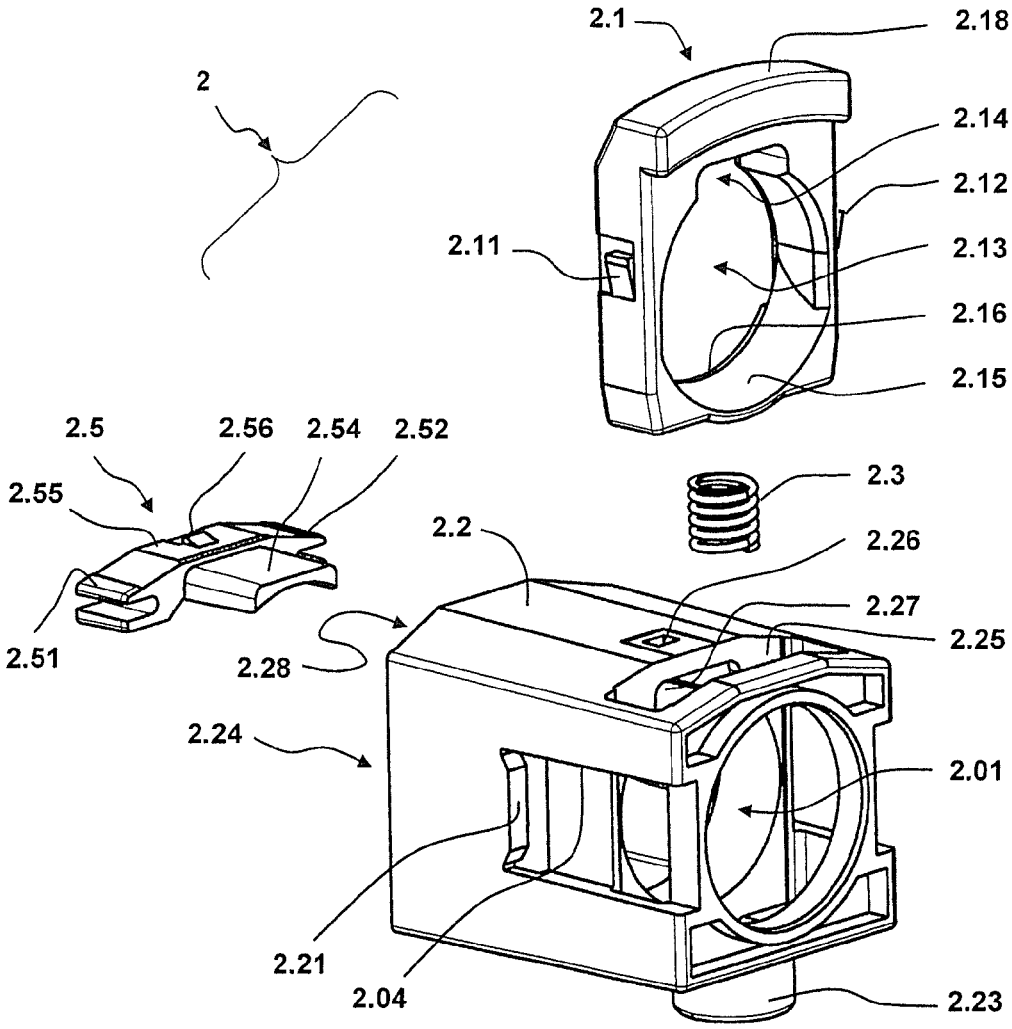
FIG. 6 is a perspective view of the ink connection holder in an exploded presentation.

The ink connection holder 2 is shown in an exploded presentation in FIG. 6 and possesses a mountable compression spring 2.3 and the unlocking button 2.1 that can be inserted into a fifth opening 2.25 on the top side of the cap-shaped base body 2.2 of the ink connection holder 2, perpendicular to the mounting movement of the rapid action cartridge coupling.

The unlocking button 2.1 is secured against falling out by lateral catch noses 2.11 and 2.12 (2.12 not visible) if the unlocking button 2.1 is mounted. The latter lies close to the first opening 2.01 which is molded in the base body 2.2 for the coupling and centrally has an oval opening 2.13 which is fashioned to guide the rapid action cartridge coupling through upon insertion into the cap-shaped base body 2.2 of the ink connection holder 2. The oval opening 2.13 transitions upwardly into a flat opening 2.14 for a guide piece 2.5 and is limited downward by a conical guide 2.15. The latter has the effect that the unlocking button 2.1 is moved downward counter to an elastic force of a compression spring 2.3, perpendicular to the mounting direction of the rapid action cartridge coupling, if the rapid action cartridge coupling is inserted into the opening 2.01 of the ink connection holder 2. The conical guide 2.15 of the unlocking button 2.1 has a low edge near to and in the direction of the first opening 2.01 and has an opposite high edge 2.16 that is fashioned correspondingly high in order to secure the rapid action cartridge coupling. The securing and unlocking of the rapid action cartridge coupling is explained in detail further below.

Upon insertion, the rapid action cartridge coupling presses on one side on the conical guide 2.15 of the unlocking button 2.1, counter to the elastic force of the compression spring 2.3 perpendicular to the mounting direction of the rapid action cartridge coupling. The unlocking button 2.1 has on the top side an actuation surface 2.18 and, upon actuation, presses with the opposite underside on the compression spring 2.3 which, in the mounted state and without actuation of the unlocking button 2.1, is only slightly compressed. As a result of an actuation of the unlocking button 2.1 (via exertion of a pressure on the actuation surface 2.18), the compression spring 2.3 is strongly compressed. The connection between the ink connection holder 2 and the rapid action cartridge coupling can thereby be released again.

FIG. 6 likewise shows a perspective view of the base body 2.2 of the ink connection holder 2. A pot-shaped receptacle 2.23 with a cavity for the compression spring 2.3 is molded on the underside of the base body 2.2, wherein the pot-shaped receptacle 2.23 is open in the direction towards the fifth opening 2.25 of the cap-shaped base body 2.2. The cavity in the pot-shaped receptacle 2.23 is dimensioned corresponding to the dimensions of the compression spring 2.3.

The base body 2.2 of the ink connection holder 2 has two lateral faces, each with a straight and flat outer surface which respectively possesses a window-shaped opening. The respective upper edge 2.04 (2.06 is not visible) at the window-shaped opening serves as a stop for the two catch noses with which the unlocking button 2.1 is secured against falling off. The left lateral surface of the unlocking button 2.1 has a catch nose 2.11 that abuts the upper edge 2.04 of the left-side window-shaped opening. The right lateral surface of the unlocking button 2.1 likewise has a catch nose 2.12 (not visible) that abuts the upper edge 2.05 (not visible) of the right-side window-shaped opening.

Both window-shaped openings respective have an additional catch edge 2.21 and 2.22 (2.22 not visible) on the respective edge which is nearest the connection for ink supply. The fourth opening 2.24 of the hollow space (not visible) arranged within the ink connection holder 2 is provided at the side of the connection. The fourth opening 2.24 is conically widened in a known manner towards the inside of the flat side walls. Upon placement on the connector (not shown) of a special ink cartridge, the base body 2.2 engages in the molded (behind the edges) cavities of the elastic clips of the connector by means of its laterally molded catch edge 2.21 and its oppositely arranged catch edge 2.22 (2.22 not visible).

An additional flat opening 2.28 (not visible) which is fashioned for insertion of the guide piece 2.5 into the ink connection holder 2, corresponding to the flat, T-shaped shape of the guide piece 2.5, is arranged over the fourth opening 2.24. The guide piece has two lateral, oppositely arranged wing pieces 2.51, 2.52, a flat middle part 2.55 and a flat head part 2.54. The guide piece 2.5 is inserted with the flat head part 2.54 leading into the additional flat opening 2.28 (not visible) of the ink connection holder 2 after the unlocking button 2.1 has been inserted into the fifth opening 2.25 of the cap-shaped base body 2.2 of the ink connection holder 2. The flat opening 2.14 in the unlocking button 2.1 accepts the flat head part 2.54, wherein the latter and the flat middle part 2.55 exhibit a concavely curved underside to guide the rapid action cartridge coupling. The flat middle part 2.55 possesses on the top side a catch nose 2.56 that, as a result of the insertion of the guide part 2.5 into the additional flat opening 2.28 (not visible) of the in connection holder 2, engages with a quadratic sixth opening 2.26 on the top side of the cap-shaped base body 2.2 of the ink connection holder 2. A third snap-in connection is realized via the aforementioned means in order to attach the guide piece 2.5 in the base body 2.2.

Figure 7:
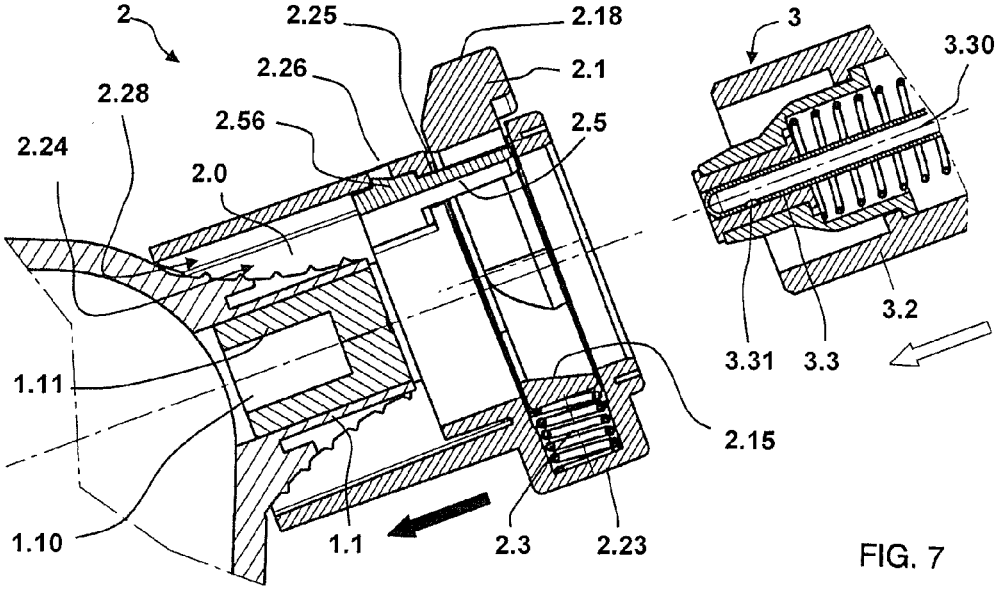
FIG. 7 is a side view, in section, of a part of the rapid action cartridge coupling (to the right) and of the ink connection holder placed on the connector of an ink cartridge (to the left) before an insertion of the rapid action cartridge coupling.

The hollow space (not visible in FIG. 6) in the cap-shaped base body 2.2 is shown in section in FIG. 7, extends from the side of the connection 1.1 for ink supply with the fourth opening 2.24 and the additional flat opening 2.28 (2.28 not visible) to a seventh opening 2.27, and near the opening 2.27 transitions upward into the quadratic sixth opening 2.26 to which the fifth opening 2.25 (into which the unlocking button 2.1 is inserted) is adjacent.

FIG. 7 shows a sectioned side view of a portion of the rapid action cartridge coupling (right) and a sectioned side view of the ink connection holder placed on the connector of a special ink cartridge (left) at a time before insertion of the rapid action cartridge coupling. Before this time, the ink connection holder is placed on the connector of the ink cartridge. The mounting direction is identified with a black arrow.

Alternatively, the ink connection holder can be placed on the connector of an ink print head (not shown).

The connector 1.1 of the special ink cartridge that serves for ink supply to the ink print head is shown in section (the section being through the center of the connector 1.1) in FIG. 7 and has a cylindrical septum 1.11, with a cylindrical hollow space 1.10. Upon insertion of the rapid action cartridge coupling 3, its hollow needle 3.3 is inserted into the septum 1.11 in a known manner until the cylindrical hollow space 1.10 is connected with the hollow space 3.30 of the hollow needle 3.3 via an opening 3.31 in the hollow needle.

On the side of the connector 1.1 for ink supply, the opening 2.24 of the hollow space 2.0 of the ink connection holder 2 is conically widened in a known manner. An additional flat opening 2.28 which forms a wide and flat curve for the insertion of the guide piece 2.4 into the ink connection holder 2—i.e. that is fashioned corresponding to the flat, curved T-shaped shape of the guide piece 2.5—is arranged over the aforementioned opening. The guide piece 2.5 ensures a guidance that is unambiguous and certain. It allows an optimally short guide length to be achieved. At the same time it can be avoided that the rapid action cartridge coupling abuts the inevitably arising protruding contour on the upper side of the ink connection holder. This guide piece is designed so that the rapid action cartridge coupling can be safely directed past the protruding contour. After establishing a fluid connection by means of the hollow needle of the rapid action cartridge coupling that penetrates through the septum, the rapid action cartridge coupling is held by the unlocking button which presses the rapid action cartridge coupling into a hold position against the guide piece by means of elastic force.

The quadratic opening 2.26 on the top side of the cap-shaped base body 2.2 of the ink connection holder 2 and the catch node 2.56 of the guide piece 2.5 are components of the snap-in connection with which the guide piece 2.5 is attached in the base body 2.2.

FIG. 7 furthermore shows an ink connection holder that on the one hand accommodates the compression spring 2.3 in a pot-shaped receptacle 2.23 and on the other hand accommodates an unlocking button 2.1 that was inserted into the fifth opening 2.25 arranged above it and is directed in the base body 2.2 perpendicular to the mounting movement of the rapid action cartridge coupling. The unlocking button has an actuation surface 2.18 on the top side and is charged with an elastic force by the compression spring 2.3 on the opposite underside. In the state of a mounted rapid action cartridge coupling, the compression spring 2.3 likewise presses the unlocking button into the drawn position in order to secure the rapid action cartridge coupling. During the insertion of the rapid action cartridge coupling 3, the conical guide 2.15 arranged on the lower side of the unlocking button 2.1 has the effect that the unlocking button 2.1 is moved counter to the elastic force of the compression spring 2.3, perpendicular to the mounting direction (white arrow) of the rapid action cartridge coupling, and performs a dodging motion so that a further insertion of the rapid action cartridge coupling 3 is possible.

To release the connection, via manual actuation of the unlocking button the user can move the button counter to the elastic force, perpendicular to the mounting direction of the rapid action cartridge coupling, whereby this is then released. The rapid action cartridge coupling can now be unmounted without difficulty.

Figure 8:
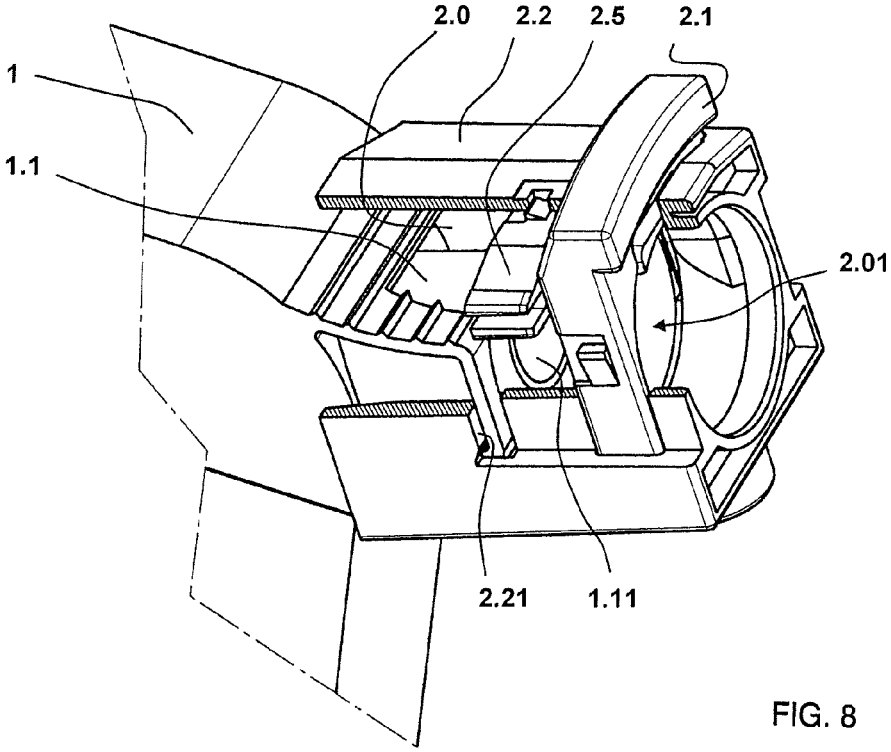
FIG. 8 shows an ink connection holder drawn in section in perspective view, wherein the ink connector holder is placed on the connector of the special ink cartridge.

FIG. 8 shows an ink connection holder drawn in section in a perspective view that is placed on the connector 1.1 of the special ink cartridge 1. The base body 2.2 is cut longitudinally. This illustrates the hollow space 2.0, the septum 1.11, the arrangement of the guide piece 2.5 placed both centrally and above in the base body 2.2, and the position of the unlocking button 2.1 near the first opening 2.01 of the ink connection holder. The hollow space 2.0 is bounded by side walls that are fashioned so as to be flexible and expandable for placement on the connector. In window-shaped openings arranged on both sides, catch edges 2.21, 2.22 (2.22 not visible) lie at the respective edge which is nearest the connector 1.1 for ink supply. Once the connection has been initially established, it can no longer be detached nondestructively.

Figure 9:
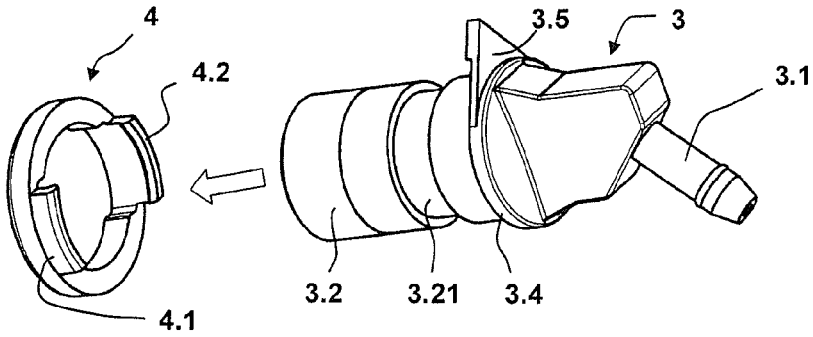
FIG. 9 is in exploded perspective view of a rapid action cartridge coupling and a coding ring.

FIG. 9 shows a perspective view of a rapid action cartridge coupling and a coding ring in exploded depiction. The known rapid action cartridge coupling 3 on the right image half possesses a hose connector 3.1 for ink supply at one end and a coupling 3.2 on the other end. The coupling bears an annular groove 3.21 on the outside. The rapid action cartridge coupling 3 possesses in the middle part a projecting, annular edge 3.4 with a node 3.5. The coding ring 4 (left image half) has two molded snap hooks 4.1, 4.2 which are fashioned so as to be correspondingly projecting in order to snap in the projecting, annular edge 3.4.

Figure 10:
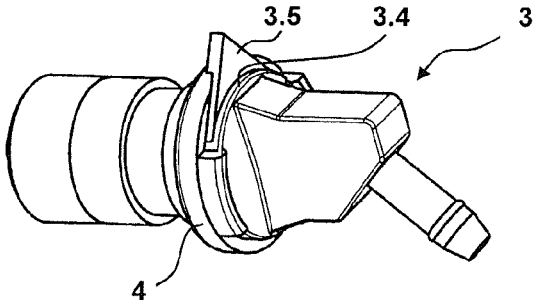
FIG. 10 shows a mounted coding ring on a rapid action cartridge coupling in a perspective view.

FIG. 10 shows a mounted coding ring 4 on a rapid action cartridge coupling in perspective presentation. The coding ring 4 reinforces the edge 3.4 in the mounted state.

Figure 11:
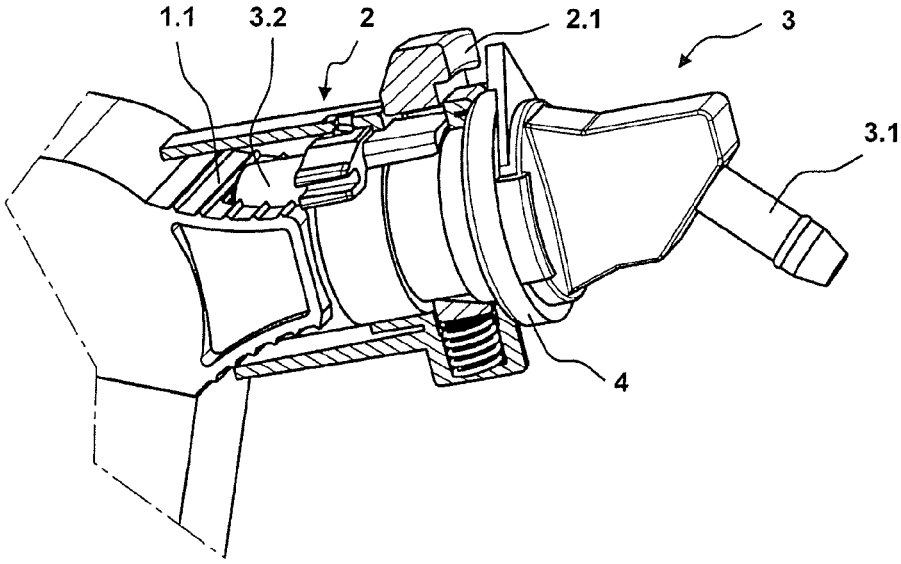
FIG. 11 is a perspective view, in section, of the mounted plug connection for ink supply to the special ink cartridge with an ink connection holder drawn.

FIG. 11 shows a perspective view of the mounted plug connection for ink supply to the special ink cartridge, with an ink connection holder drawn in section. The special ink cartridge 1 possesses an ink print head, an ink reservoir and a connector 1.1 for ink supply. The ink connection holder 2 is placed on the connector 1.1 and drawn in section. The ink connection holder is equipped with the unlocking button 2.1 (likewise shown in section) to detach the connection with the rapid action cartridge coupling 3.

In contrast to the coupling 3.2, a connection of a hose line with the hose connector 3.1 can only be detached with difficulty. It is therefore used at the points of a hose line (not shown) where a durable and fixed connection is required. Tube connectors typically have ribbed or corrugated ends in order to prevent a slippage of the hose.

In order to additionally ensure a safeguard against confusion with regard to the components of the special ink printing system from HP (known from the prior art), the ink connection holder 2 was executed somewhat shorter in length than the length of the securing cap. At the same time, the known rapid action cartridge coupling 3 is provided with a coding ring 4 that is provided with catch noses that form a fourth snap-in connection with the known rapid action cartridge coupling 3 so that the coding ring is connected positively and non-positively with the latter (FIG. 10). The thickness of the coding ring corresponds precisely to the degree by which the length of the known securing cap 2* differs from the length of the ink connection holder 2. It is thus not possible to mount the coded rapid action cartridge coupling in systems with the known securing cap.

The ink connection holder 2 is placed on a connector for ink supply, with the connection designed so that it cannot be nondestructively released. Instead of an unlocking button 2.1 to detach the coded rapid action cartridge coupling 3, a different unlocking element can alternatively be provided. It is only significant that the latter connection is designed so that it can be nondestructively released.

Figure 12:
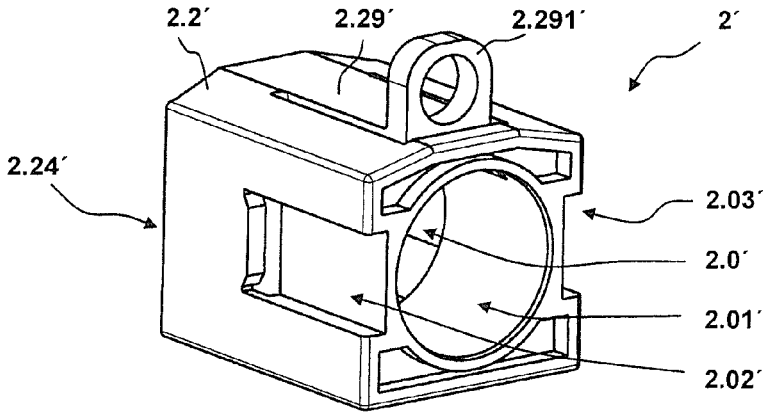
FIG. 12 shows a second variant of the ink connection holder in perspective view.

FIG. 12 shows a second variant of the ink connection holder 2' in perspective view. It is provided that the ink connection holder 2' has a base body 2.2' and an elastic part 2.29' molded on the latter, wherein the base body 2.2' is equipped with: a hollow space 2.0' and with a first opening 2.01' for insertion of the rapid action cartridge coupling 3'; a second opening 2.02' and third opening 2.03'; and a fourth opening 2.24' for insertion of the connector of a special ink cartridge or the connector of an ink print head, as was already explained in the first variant using FIG. 5. In contrast to this, the additional openings four through eight in the base body 2.2' are missing. The elastic end (not visible) of the elastic part 2.29' that is directed toward the hollow space 2.0' is fashioned as a separate snap-in connection for interaction with a groove of the rapid action cartridge coupling. The ink connection holder 2' has a clip 2.291' which is molded on the elastic end of the elastic part 2.29' of the second snap-in connection and is directed outwards.

Figure 13:
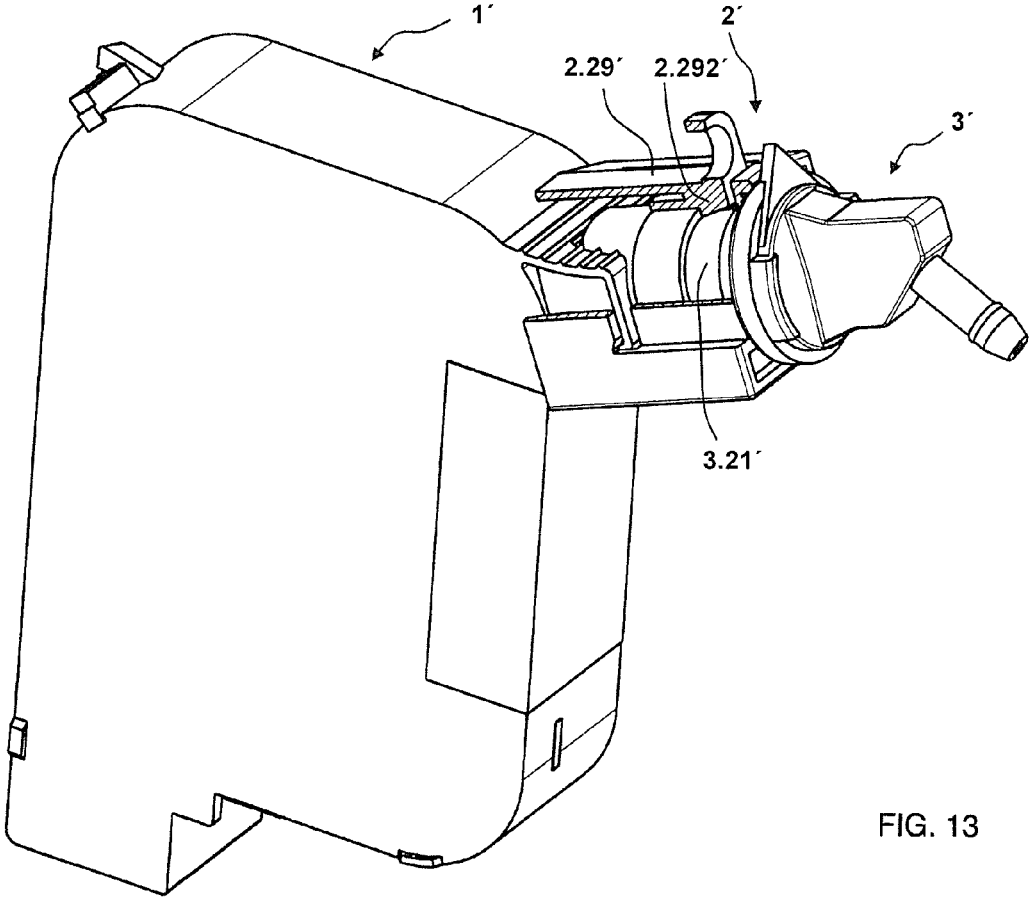
FIG. 13 is a perspective view of the mounted plug connector for ink supply to the special ink cartridge, with an ink connection holder shown in section according to the second variant, and with inserted rapid action cartridge coupling.

FIG. 13 shows a perspective view of the mounted plug connection for ink supply to the special ink cartridge 1', with an ink connection holder 2' drawn in section and with inserted rapid action cartridge coupling 3'. The second snap-in connection is fashioned to interact with a groove 3.21' of the rapid action cartridge coupling so that the conical end 2.292' of the elastic part 2.29' that is directed towards the hollow space 2.0' snaps into the groove 3.21'.

Figure 14:
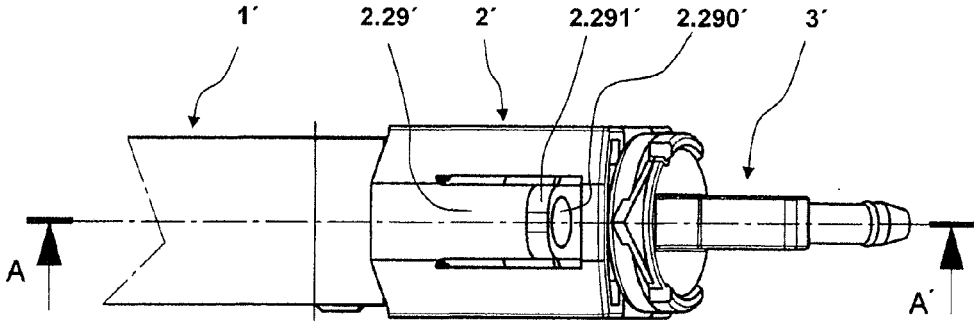
FIG. 14 is a plan view of a portion of the special ink cartridge with the mounted second variant of the ink connection holder and inserted rapid action cartridge coupling.

FIG. 14 shows a plan view of a part of the special ink cartridge with the mounted second variant of the ink connection holder 2' and inserted rapid action cartridge coupling 3'. The second snap-in connection is arranged near the inserted rapid action cartridge coupling 3' at the conical end of the elastic part 2.29'. The outwardly directed clip 2.291' at the conical end of the elastic part 2.29' has an opening 2.290' for actuation of the elastic part 2.29'. A center line A-A' divides the opening 2.290' and the entire mounted plug connection for ink supply to the special ink cartridge 1'.

Figure 15:
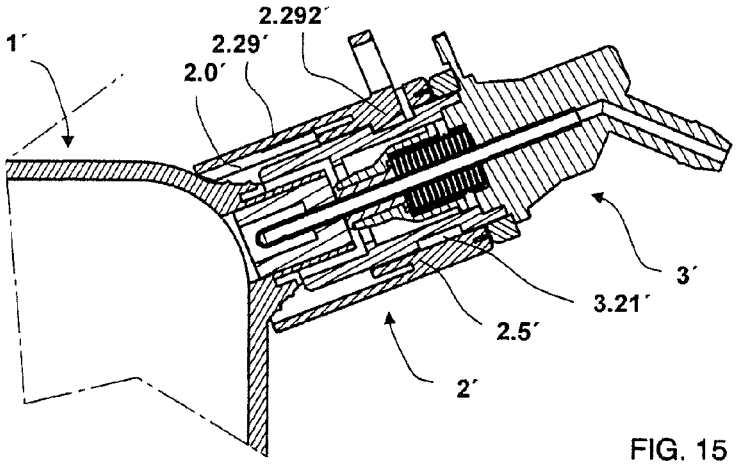
FIG. 15 is a section along the center line A-A' through the portion of the special ink cartridge with the mounted second variant of the ink connection holder and inserted rapid action cartridge coupling.

FIG. 15 shows a section along the center line A-A' through the part of the special ink cartridge 1' with the mounted second variant of the ink connection holder 2' and inserted rapid action cartridge coupling 3'. A conical guide 2.292' sits, directed inward toward the hollow space 2.0', on the end of the elastic part 2.29' which is molded on the base body 2.2' of the ink connection holder 2' on a side facing towards the connector and at which the side facing towards the inserted rapid action cartridge coupling 3' is fashioned in an elastic form.

A guide 2.5' (situated in the hollow space 2.0' and permanently molded on the base body 2.2') to guide the coded rapid action cartridge coupling 3' is arranged opposite the conical guide 2.292', thus the second snap-in connection. The second snap-in connection is advantageously arranged within the base body 2.2', near a groove 3.21' of the coded rapid action cartridge coupling 3' inserted into the ink connection holder 2'.

Alternatively, the snap-in connection can be arranged below or to the side within the base body 2.2', near the groove 3.21' of the coded rapid action cartridge coupling 3' inserted into the ink connection holder 2'.

The conical guide 2.292' engages in the groove 3.21' if the coded rapid action cartridge coupling 3' is inserted into the ink connection holder 2'. An actuation means (not shown) to unlock the second snap-in connection can act at the clip 2.291' of the elastic part 2.29' if the ink connection holder 2'. The actuation means is, for example, a lever or draw hook to raise up or hoist the second snap-in connection in order to release the inserted, coded rapid action cartridge coupling 3' again if the elastic end of the elastic part 2.29' is deflected perpendicular to the mounting movement of the coded rapid action cartridge coupling.

The first snap-in connection between the connector 1.1' of the ink connection holder 2' and the special ink cartridge 1' or, respectively, the ink print head can in principle be executed as in the first variant of the ink connection holder 2'.

Alternatively, the first snap-in connection can be executed as in the known securing cap or similarly, corresponding to the shape of the connection.

The coding means can be fashioned as a coding ring 4 or as a spacer that is attached to the rapid action cartridge coupling. In the simplest case the spacer consists of a molded part which is attached via adhesion on the circumference of the rapid action cartridge coupling.

The length of the spacer 8 or, respectively, the thickness of the coding ring 4 corresponds to the difference between the length of the known securing cap 2* and the length of the ink connection holder 2 and 2'.

Figure 16:
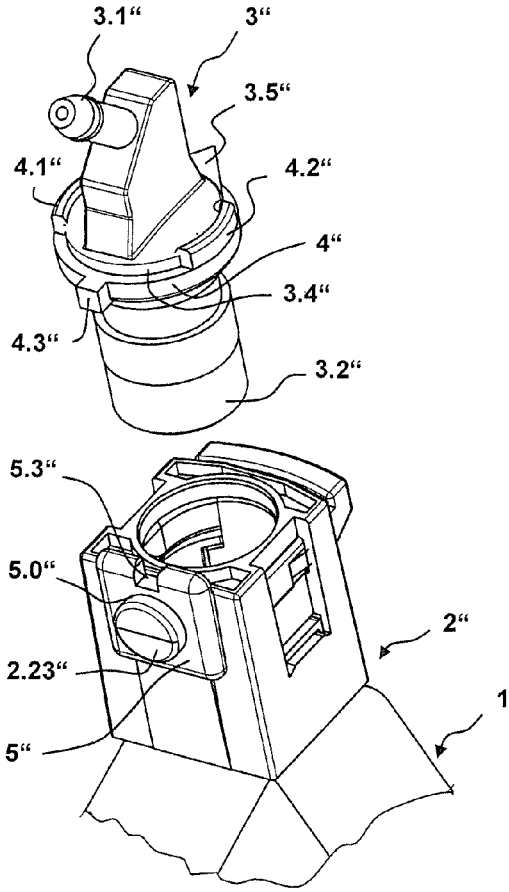
FIG. 16 is a perspective view of a third variant of the plug connection for ink supply before mounting of the rapid action cartridge coupling.

FIG. 16 shows a perspective view of a third variant of the plug connection for ink supply before the mounting of the rapid action cartridge coupling. An ink connection holder 2" is placed on the connector of an ink cartridge 1". The rapid action cartridge coupling 3" is shown at a point in time before its insertion into the ink connection holder 2". The rapid action cartridge coupling 3" bears: a tube connector 3.1" for ink supply at one end and a coupling 3.2" at the other end; a projecting, annular edge 3.4" with a nose 3.5" in the middle part; a coding ring 4" that is attached to the edge 3.4" by means of two snap hooks 4.1", 4.2"; and a coding segment 4.3".

The ink connection holder 2" has a mountable flat key body 5" with a hole 5.0". The pot-shaped receptacle 2.23" of the ink connection holder is inserted through the hole 5.0" and, for example, is fastened by a fifth snap-in connection or via adhesion. A key segment is fashioned matching the coding segment 4.3". In the shown, simplest case, the key body 5" possesses a notch 5.3" that is fashioned matching the shape of the coding segment 4.3". The notch 5.3" is drawn as a quadrilateral depression. The coding segment 4.3" is likewise fashioned as a quadrilateral projection that is molded on the outer edge of the coding ring 4".

Alternatively, the notch can be v-shaped and the coding segment 4.3" can be fashioned matching this as a triangular nose.

Alternatively, the notch can be u-shaped and the coding segment 4.3" can be fashioned matching this as a rounded counterpart.

Alternatively, the notch can be arbitrarily shaped. The coding segment 4.3" is fashioned matching this as a corresponding, counterpart shaped in a complementary manner.

Figure 17:
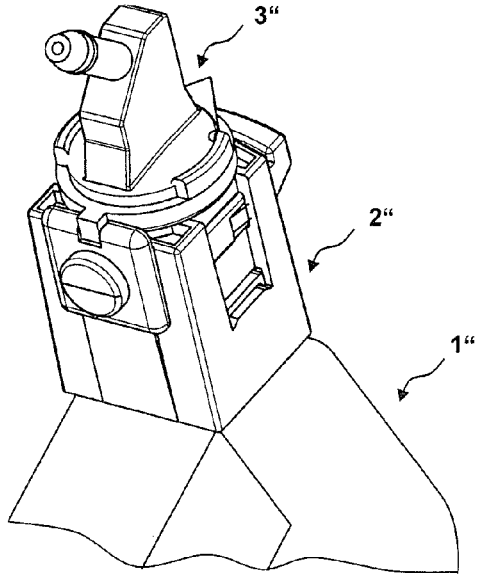
FIG. 17 is a perspective view of the third variant of the plug connection for ink supply with mounted rapid action cartridge coupling.

FIG. 17 shows a perspective view of the third variant of the plug connection for ink supply with ink cartridge 1" and a rapid action cartridge coupling 3" mounted on the ink connection holder 2".

Figure 18:
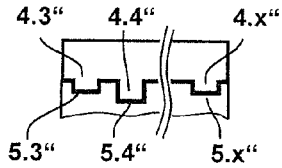
FIG. 18 is a plan view of a key body of a fourth variant.

FIG. 18 shows a plan view of a key body of a fourth variant. The key body 5" possesses a number of notches 5.3", 5.4", . . . **5.*x*", and the coding segment is fashioned matching this with noses 4.3", 4.4", . . . 4.*x*"** as a counterpart with complementary shape.

The counterpart can exist in a number of identically fashioned noses which is equal to the number of notches in the key body.

The counterpart can exist in a number of differently fashioned noses which is equal to the number of notches in the key body, and wherein the notches are respectively fashioned in shapes correspondingly matching the associated nose.

The individual noses 4.3", 4.4", . . . **4.*x*"** of the coding segment can be molded with the same or different spacing on the coding ring, wherein the associated notches in the key body are spaced from one another in the same manner.

Alternatively, a variant is also possible in which, instead of an association of noses and notches with coding segment and key body, the reverse is now produced with key body and coding segment.

An arbitrary combination of noses and notches that occur both in the coding segment and in the key segment of the key body is also likewise possible, wherein the corresponding counterpart to the arrangement of noses and notches that is presented in the coding segment is realized again in the key body. The coding means this possesses noses and/or notches in the coding segment, an the key body mounted on the ink connection holder exhibits a key segment shaped in a complementary manner.

A nose can alternatively be a component of a spacer or the latter can itself form the nose.

In each of the aforementioned variants the embodiment thus ensues so that a coding means (a coding ring or, respectively, a spacer according to the aforementioned embodiment) mounted on a known rapid action cartridge coupling fits only in precisely one key body that matches this and is mounted on the ink connection holder. An ink connection holder is coded in a defined manner with every key body. The mounting of a rapid action cartridge coupling coded in a specific manner with all differently coded ink connection holders is thus prevented.

Figure 19:
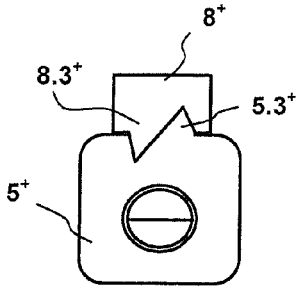
FIG. 19 is a plan view of a spacer with coding segment and of a key body.

FIG. 19 shows a plan view of a spacer with coding segment and a key body according to a further variant in which a spacer $8^+$ is provided instead of a coding ring. Said spacer $8^+$ is fastened to the rapid action cartridge coupling and is shaped as a coding segment $8.3^+$ at the one end. The key body $5^+$ has a counterpart $5.3^+$ matching this, shaped in a complementary manner.

Figure 20:
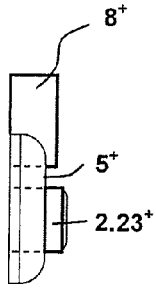
FIG. 20 is a side view of the spacer according to FIG. 18.

FIG. 20 shows a side view of the aforementioned additional variant with spacer 8$^+$ and key body 5$^+$ that is fastened by placement on the pot-shaped receptacle 2.23 of the ink connection holder.

Figure 21:
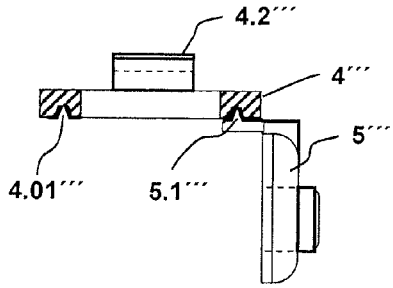
FIG. 21 shows additional variant with ring (annular) profile.

FIG. 21 shows a further variant in which a coding ring 4" is provided with an ring [annular] profile 4.01'" on the ring underside which is facing towards the ink connection holder. The key body 5'" of the ink connection holder must likewise be fashioned matching the ring profile 4.01'". The ring profile 4.01'" can be executed as at least one annular groove. The counterpart consists of at least one elevation arranged in an annular section or of a ring or, respectively, collar 5.01" that is attached at an angle on the key body 5'".

Alternatively, the ring profile can be executed as at least one ring or an annular elevation, and that a counterpart of complementary shape to this exists that is attached at an angle on the key body.

The advantage of the two last cited variants is a free rotation capability of the rapid action cartridge coupling in the angle range of 0°-360°.

The arrangement of noses and notches is produced without undercuts, meaning that the noses and notches match one another not only in terms of the shape, but rather that the noses and notches are fashioned so as to be pluggable and detachable from one another again. This can ensue by the noses being tapered in the direction of the notches and/or the openings of the notches being shaped widening at the entrance side.

A ring or an annular elevation and the associated counterpart exhibit a shape that is likewise executed without undercuts.

The invention is not limited to a present embodiment with special ink cartridge. The ink connection holder 2 can be shaped differently and can also be connected with a connector of an ink print head or with similar connectors.

Although modifications and changes may be suggested by those skilled in the art, it is the intention of the inventors to embody within the patent warranted hereon all changes and modifications as reasonably and properly come within the scope of their contribution to the art.

We claim as our invention:

1. A plug connection for an ink supply between an ink container having an ink supply connector, and an ink-consuming component that withdraws ink from said ink supply via said ink supply connector, said plug connection comprising:

an ink connection holder configured for placement against said ink supply and around said ink supply connector;

a coded rapid action cartridge coupling forming a part of said ink-consuming component, said coded rapid action cartridge coupling comprising a mechanical cartridge coupling coding;

a guide in said ink connection holder that guides said coded rapid action cartridge coupling to produce a fluid connection with said ink supply connector, said guide comprising a guide mechanical coding that is coded with respect to said cartridge coupling mechanical coding to allow said guide to accept only a coded rapid action cartridge coupling having a cartridge coupling mechanical guide that corresponds to said guide mechanical coding; and an unlocking element in said ink connection holder being manually manipulable and being mounted for movement in said ink connection holder between a locked position that maintains said ink connection holder, said ink supply connector and said coded rapid action cartridge coupling in place relative to each other, and an unlocking position that allows removal of said coded rapid action cartridge coupling from said ink connection holder and removal of said ink connection holder from said ink supply connector.

2. A plug connection as claimed in claim 1 wherein said ink connection holder comprises a snap-in connection configured to connect said ink connection holder to said ink supply connector.

3. A plug connection as claimed in claim 1 wherein said ink connection holder comprises a snap-in connection configured to hold said ink connection holder to said coded rapid action cartridge coupling.

4. A plug connection as claimed in claim 1 wherein said ink connection holder comprises a first snap-in connection configured to hold said ink connection holder to said ink supply connector, and a second snap-in connection configured to hold said ink connection holder to said coded rapid action cartridge coupling, each of said first and second snap-in connection being non-destructively operable to release said ink connection holder from said ink supply connector and from said coded rapid action cartridge coupling.

5. A plug connection as claimed in claim 1 wherein said ink connection holder comprises a base body containing a hollow space bounded by sidewalls configured to allow placement of said ink supply connector in said hollow space.

6. A plug connection as claimed in claim 5 wherein said unlocking element is an unlocking button and wherein said guide is a guide piece, said unlocking button being mounted in said ink connection holder and being held therein by lateral catch noses, and being mounted in said ink connection holder next to an opening of said hollow space, said opening being configured to allow insertion of said coded rapid action cartridge coupling into said ink connection holder, and said unlocking button comprising an oval opening therein configured to allow insertion of said coded rapid action cartridge coupling therethrough into said hollow space in said ink connection holder, and having a flat opening configured to receive said guide piece, said oval opening transitioning upwardly into said flat opening, and said oval opening comprising a conical opening wall in said unlocking button transitioning between a larger side of said oval opening and a smaller side of said oval opening, said smaller side of said oval opening being configured to secure said coded rapid action cartridge coupling.

7. A plug connection as claimed in claim 6 wherein said ink connection holder is configured to accept said coded rapid action cartridge coupling therein as said coded rapid action cartridge coupling is inserted in an insertion direction, and wherein said unlocking button is mounted in said ink connection holder for movement perpendicular to said insertion direction.

8. A plug connection as claimed in claim 1 wherein said guide comprises a guide piece that is mounted in said ink connection holder at a location causing said guide mechanical coding to mechanically interact with said cartridge coupling mechanical coding.

9. A plug connection as claimed in claim 1 wherein said ink connection holder comprises a hollow space therein having a first opening that receives said coded rapid action cartridge coupling, and a second opening that receives said ink supply connector, said ink connection holder comprising an elastic component retained in said base body and surrounding said hollow space inside said base body, said elastic component comprising an interior, conical guide configured to receive said coded rapid action cartridge coupling, and a snap-in connection configured to form a snap connection with said ink supply connector, and wherein said guide is permanently molded in said base body in said hollow space.

10. A plug connection as claimed in claim 1 wherein each of said coupling cartridge mechanical coding and said guide mechanical coding is formed by a coding element, selected from the group consisting of spacers and rings.

11. A plug connection as claimed in claim 1 wherein said cartridge coupling mechanical coding comprises a spacer fastened on a circumference of said coded rapid action cartridge coupling.

12. A plug connection as claimed in claim 11 wherein said ink supply connector is configured to be closed by a securing cap, and wherein said spacer has a length equal to a difference between a length between said securing cap and a length of said ink connection holder.

13. A plug connection as claimed in claim 12 wherein said coded rapid action cartridge coupling comprises a tube connector at a first end and a coupling element at a second end opposite to said first end, and a projecting annular edge located between said first and second ends, and a coding ring fastened at said edge by snap hooks, said coding ring carrying said coupling cartridge mechanical coding, and wherein said guide comprises a key body mountable in said ink connection holder, said key body carrying said guide mechanical coding.

14. A plug connection as claimed in claim 13 wherein said coding ring carries said coupling cartridge mechanical coding in a coding segment thereof, and wherein said key body comprises a notch configured to match a shape of said coding segment.

15. A plug connection as claimed in claim 14 wherein said notch comprises a plurality of quadrilateral recesses, and wherein said coding segment comprises a matching plurality of quadrilateral projections at an outer edge of said coding ring.

16. A plug connection as claimed in claim 14 wherein said notch is V-shaped and wherein said coding segment has a matching triangular shape.

17. A plug connection as claimed in claim 14 wherein said notch is U-shaped and wherein said coding segment has a rounded shape matching said U-shape.

18. A plug connection as claimed in claim 14 wherein said notch has a notch shape and wherein said coding segment has a counterpart shape matched to said notch shape.

19. A plug connection as claimed in claim 13 wherein said key body comprises a plurality of notches therein, and wherein said coding segment comprises a plurality of counterpart projections corresponding to said plurality of notches.

20. A plug connection as claimed in claim 19 wherein said counterpart comprises a plurality of identical projections equal in number to said plurality of notches.

21. A plug connection as claimed in claim 19 wherein said counterpart comprises a plurality of differently shaped projections, equal in number to said plurality of notches, and wherein each notch in said plurality of notches respectively matched in shape to a corresponding of one of said projections.

22. A plug connection as claimed in claim 19 wherein said projections of said coding segment are molded on said coding ring at predetermined spacings from each other, and wherein said notches in said key segment are spaced from each other also with said predetermined spacings.

23. A plug connection as claimed in claim 13 wherein said cartridge coupling mechanical coding comprises a coding segment carrying a plurality of coding elements, and wherein said key body comprises a plurality of complementary coding elements that mechanically mate with said plurality of coding elements of said coding segment.

* * * * *